US008109841B2

(12) United States Patent
Miyamichi

(10) Patent No.: US 8,109,841 B2
(45) Date of Patent: Feb. 7, 2012

(54) PUTTER FACE AND GOLF PUTTER HAVING THE SAME

(75) Inventor: Saburo Miyamichi, Osaka (JP)

(73) Assignee: M-System Co., Ltd., Osaka (JP)

( * ) Notice: Subject to any disclaimer, the term of this patent is extended or adjusted under 35 U.S.C. 154(b) by 50 days.

(21) Appl. No.: 12/943,298

(22) Filed: Nov. 10, 2010

(65) Prior Publication Data

US 2011/0143859 A1 Jun. 16, 2011

(30) Foreign Application Priority Data

Dec. 16, 2009 (JP) ..... 2009-285526

(51) Int. Cl.
*A63B 53/04* (2006.01)

(52) U.S. Cl. ..... 473/340; 473/342

(58) Field of Classification Search ..... 473/251, 473/324–350

See application file for complete search history.

(56) References Cited

U.S. PATENT DOCUMENTS

| | | | | | |
|---|---|---|---|---|---|
| 732,136 | A | * | 6/1903 | Taylor | 473/331 |
| 732,137 | A | * | 6/1903 | Taylor | 473/331 |
| 749,174 | A | * | 1/1904 | Davis | 473/246 |
| D55,278 | S | * | 5/1920 | Kraeuter | D21/750 |
| D57,980 | S | * | 5/1921 | Kraeuter | D21/741 |
| 4,768,787 | A | * | 9/1988 | Shira | 473/331 |
| 4,917,384 | A | * | 4/1990 | Caiati | 473/330 |
| 4,964,641 | A | * | 10/1990 | Miesch et al. | 473/330 |
| 5,542,675 | A | * | 8/1996 | Micciche et al. | 473/329 |
| 5,688,190 | A | * | 11/1997 | Rowland et al. | 473/330 |
| 6,007,434 | A | * | 12/1999 | Baker et al. | 473/330 |
| 6,089,993 | A | * | 7/2000 | Woodward et al. | 473/331 |
| 6,110,057 | A | * | 8/2000 | McKinnon | 473/313 |
| 6,193,617 | B1 | * | 2/2001 | Mertens | 473/351 |
| 6,217,460 | B1 | * | 4/2001 | Broadbridge et al. | 473/324 |
| 6,257,994 | B1 | | 7/2001 | Antonious | |

(Continued)

FOREIGN PATENT DOCUMENTS

JP 52-144055 11/1977

(Continued)

OTHER PUBLICATIONS

Combined Search and Examination Report for United Kingdom Application No. GB1019060.1, mailed on Nov. 30, 2010.

(Continued)

*Primary Examiner* — Alvin Hunter

(74) *Attorney, Agent, or Firm* — David G. Conlin; Steven M. Jensen; Edwards Wildman Palmer LLP

(57) ABSTRACT

A putter face includes microscopic protrusions which have stiffness higher than that of a golf ball and which are smaller than intervals between dimples of the golf ball, each of the microscopic protrusions having an end having a protrusion front edge surface formed in a planar shape, a periphery of the protrusion front edge surface including linear portions facing each other and curve portions facing each other, the linear portions extending in a horizontal direction of a face plane of the putter face or striking the golf ball, the periphery of the protrusion front edge surface forming a racetrack shape (i) which is defined by a pair of the linear portions facing each other and a pair of the curve portions facing each other and (ii) which has a shorter diameter of not less than 0.1 mm but not more than 0.2 mm.

8 Claims, 9 Drawing Sheets

U.S. PATENT DOCUMENTS

| | | | | |
|---|---|---|---|---|
| 6,554,721 | B1 * | 4/2003 | Woodward et al. | 473/331 |
| 6,699,140 | B1 * | 3/2004 | Sun | 473/252 |
| 6,849,004 | B2 * | 2/2005 | Lindsay | 473/330 |
| 7,273,420 | B2 * | 9/2007 | Wright | 473/329 |
| 7,278,926 | B2 * | 10/2007 | Frame | 473/329 |
| 7,445,561 | B2 * | 11/2008 | Newman et al. | 473/330 |
| 7,465,240 | B2 * | 12/2008 | Frame | 473/329 |
| 7,824,278 | B2 * | 11/2010 | Miyamichi | 473/329 |
| 2003/0153399 | A1 * | 8/2003 | Woodward et al. | 473/331 |
| 2004/0038747 | A1 * | 2/2004 | Lindsay | 473/340 |
| 2005/0130764 | A1 * | 6/2005 | Frame | 473/340 |
| 2005/0255930 | A1 * | 11/2005 | Johnson | 473/244 |
| 2007/0243943 | A1 * | 10/2007 | Inouye et al. | 473/249 |
| 2007/0243949 | A1 | 10/2007 | Solari | |
| 2008/0132351 | A1 | 6/2008 | Ban et al. | |
| 2010/0087270 | A1 * | 4/2010 | Ban et al. | 473/331 |
| 2011/0039633 | A1 * | 2/2011 | Snyder et al. | 473/329 |

FOREIGN PATENT DOCUMENTS

| | | | |
|---|---|---|---|
| JP | 2001-513691 | | 9/2001 |
| JP | 2007117634 | A * | 5/2007 |
| JP | 3133459 | | 7/2007 |
| JP | 2010172592 | A * | 8/2010 |
| WO | 98/39068 | | 9/1998 |
| WO | WO 9839068 | A1 * | 9/1998 |

OTHER PUBLICATIONS

Japanese Office Action mailed Feb. 23, 2010 in Japanese Application 2009-285526.

Japanese Office Action mailed May 18, 2010 in Japanese Application 2009-285526.

* cited by examiner

FIG. 8

| | | | X DIRECTION | | Y DIRECTION | |
|---|---|---|---|---|---|---|
| MATERIAL | | SURFACE SHAPE | STATIC FRICTION COEFFICIENT | DYNAMIC FRICTION COEFFICIENT | STATIC FRICTION COEFFICIENT | DYNAMIC FRICTION COEFFICIENT |
| STAINLESS | EXAMPLE | MICROSCOPIC-PROTRUSION SHAPE (1.0×0.2×0.2mm) | 0.280 | 0.180 | 0.210 | 0.210 |
| | COMPARATIVE EXAMPLE | PLANE | 0.120 | 0.120 | 0.130 | 0.130 |
| POLYACETAL (POM : COMPARATIVE EXAMPLE 1) | | GROOVE SHAPE (0.3×0.15mm) | 0.165 | 0.120 | 0.110 | 0.070 |
| | | PLANE | 0.130 | 0.100 | 0.120 | 0.080 |
| POLYETHYLENE (PE : COMPARATIVE EXAMPLE 2) | | GROOVE SHAPE (0.3×0.15mm) | 0.140 | 0.110 | 0.110 | 0.110 |
| POLYBUTYLENE TEREPHTHALATE (PBT : COMPARATIVE EXAMPLE 3) | | GROOVE SHAPE (0.3×0.15mm) | 0.130 | 0.120 | 0.065 | 0.065 |

PUTTER FACE AND GOLF PUTTER HAVING THE SAME

This Nonprovisional application claims priority under 35 U.S.C. §119(a) on Patent Application No. 2009-285526 filed in Japan on Dec. 16, 2009, the entire contents of which are hereby incorporated by reference.

TECHNICAL FIELD

The present invention relates to a putter face and a golf putter including the putter face.

BACKGROUND ART

Conventionally, there have been two types of putter faces to be used for a head of a golf putter: a metallic putter face; and a non-metallic putter face, which is made from a synthetic resin or the like.

Metallic putter faces have such an advantage that due to their large coefficient of restitution associated with their high stiffness, initial rate loss and energy loss of a ball is small as compared with non-metallic putter faces. However, the metallic putter faces adversely have difficulty in improving ball controllability due to their high stiffness, as compared with the non-metallic putter faces.

On the other hand, the non-metallic putter faces are generally made from an elastic material such as a synthetic resin, for example. This allows the non-metallic putter faces to easily have better ball controllability as compared with the metallic putter faces, because a friction coefficient is large due to their elastic deformation. However, the non-metallic putter faces have such a disadvantage that the initial rate loss and energy loss of a ball is large because their coefficient of restitution is small due to their low stiffness as compared with the metallic putter faces.

As an exemplary technique related to these conventional putter faces, there is disclosed a putter head as below (Patent Literature 1).

The putter head disclosed in Patent Literature 1 includes a main body having a front face, and the front face includes a plurality of projections (protrusions] extending from the front face. The plurality of projections have, on one end portion thereof, a contact surface for striking a golf ball.

Citation List

Patent Literature 1

Japanese Translation of PCT International Publication, Tokuhyo, No. 2001-513691 (Publication Date: Sep. 4, 2001)

SUMMARY OF INVENTION

Technical Problem

It is said that the most important element in the ball controllability of the golf putter is how easily the golf putter creates topspin on a ball in a vertical direction.

Even if a golf putter is not improved in overall ball controllability, such as easiness of putting spin on a ball in various directions, it can be said that the golf putter has a sufficient performance, as long as the ball controllability of the golf putter is improved in terms of easily creating topspin on the ball in the vertical direction.

It is described in Patent Literature 1 that the putter head includes a plurality of projections so as to adjust intensity of a frictional force working on a golf ball. However, there is no description about how to control a direction in which the frictional force works. That is, Patent Literature 1 does not mention anything about a feature of how the putter head disclosed in Patent Literature 1 efficiently puts topspin on a golf ball.

The present invention is accomplished in view of the above problem. An object of the present invention is to provide a putter face that can efficiently create topspin on a golf ball and a golf putter including the putter face.

Solution to Problem

A putter face of the present invention is a putter face for use in a golf putter and includes a plurality of microscopic protrusions which have stiffness higher than that of a golf ball and which are smaller than intervals between dimples of the golf ball, each of the plurality of microscopic protrusions having an end having a protrusion front edge surface formed in a planar shape, a periphery of the protrusion front edge surface including a plurality of linear portions facing each other and a plurality of curve portions facing each other, the plurality of linear portions extending in a horizontal direction of a face plane of the putter face which horizontal direction the face plane is supposed to have at a time of striking the golf ball, the periphery of the protrusion front edge surface forming a racetrack shape (i) which is defined by a pair of the linear portions facing each other and a pair of the curve portions facing each other and (ii) which has a shorter diameter of not less than 0.1 mm but not more than 0.2 mm.

In the arrangement, the putter face of the present invention includes a plurality of microscopic protrusions which have stiffness higher than the golf ball and which are smaller than intervals between dimples of the golf ball. With the arrangement, even in a case where the putter face makes contact with a spherical surface between the dimples of the golf ball at the time of striking the golf ball, the microscopic protrusions can bite into a ball surface so sufficiently that contact portions of the ball surface to the microscopic protrusions are deformed.

Further, in the putter face of the present invention, the periphery of the protrusion front edge surface includes a plurality of linear portions facing each other and a plurality of curve portions facing each other, and the plurality of linear portions extend in the horizontal direction of the face plane.

With the above arrangement, a drag force exerted on the golf ball from the linear portion at the time of striking the golf ball is uniformly exerted in a normal line direction of the linear portion (i.e., the vertical direction of the face plane). On the other hand, a drag force exerted on the golf ball from the curve portion is distributed into normal line directions of the curve portion (that is, the drag force is exerted not uniformly along the horizontal direction of the face plane but is distributed into multiple directions). As such, the above arrangement allows a vertical component of a static frictional force exerted on the golf ball from the microscopic protrusion at the time of striking the golf ball to be larger than a horizontal component of the static frictional force.

In this way, with the above arrangement of the present invention, the directivity of the static frictional force to the vertical direction is increased, thereby making it possible to easily obtain a rolling force in a forward direction and to adversely restrain a rolling force in non-forward directions.

Furthermore, by adjusting the number, size, and placement of the microscopic protrusions per unit area of the face plane, it is possible to freely adjust intensity of the static frictional force and the directivity of the static frictional force to the vertical direction.

The intervals of dimples are averagely about 0.51 mm in a case of a golf ball having 300 to 400 dimples.

Further, in the above arrangement, the periphery of the protrusion front edge surface of each of the plurality of microscopic protrusions forms a racetrack shape including a pair of linear portions facing each other and a pair of curve portions facing each other. Therefore, a drag force exerted on the golf ball from each of the linear portions in the pair at the time of striking the golf ball is exerted uniformly in a normal line direction of the each of the linear portions (i.e., a vertical direction of the face plane). On the other hand, a drag force exerted on the golf ball from each of the curve portions in the pair is distributed into normal line directions of the each of the curve portions (that is, the drag force is exerted not uniformly along the horizontal direction of the face plane but is distributed into multiple directions). Accordingly, the above arrangement allows a vertical component of the static frictional force exerted on the golf ball from the microscopic protrusion at the time of striking the golf ball to be larger than a horizontal component of the static frictional force.

In a case where the longer diameter of the racetrack shape of the periphery is less than 0.3 mm, the size of the microscopic protrusion is too small. Accordingly, the drag force (grip effect) working on the golf ball becomes small and the static frictional force is reduced. As a result, it is difficult to obtain the rolling force sufficiently.

On the other hand, in a case where the longer diameter of the racetrack shape of the periphery exceeds 0.5 mm, the size of the microscopic protrusion is larger than the interval between the dimples, thereby making it difficult for the curve portions of the protrusion front edge surface to make contact with a spherical surface between the dimples on the ball surface. As a result, it becomes hard to obtain the drag force exerted on the ball from the putter face in the horizontal direction, thereby extremely reducing the static frictional force in the horizontal direction and rendering the ball controllability worse.

Further, in a case where the shorter diameter of the racetrack shape of the periphery is less than 0.1 mm, it is difficult to form the microscopic protrusions by a half-etching method.

On the other hand, in a case where the shorter diameter of the racetrack shape of the periphery exceeds 0.2 mm, a distance between the linear portions is too large, thereby preventing the microscopic protrusion from biting into the ball surface. As a result, the static frictional force in the vertical direction becomes small, thereby rendering the ball controllability worse.

In view of this, with the above arrangement of the present invention, it is possible to efficiently create topspin on the golf ball.

ADVANTAGEOUS EFFECTS OF INVENTION

As described above, the putter face of the present invention includes a plurality of microscopic protrusions which have stiffness higher than that of a golf ball and which are smaller than intervals between dimples of the golf ball, each of the plurality of microscopic protrusions having an end having a protrusion front edge surface formed in a planar shape, a periphery of the protrusion front edge surface including a plurality of linear portions facing each other and a plurality of curve portions facing each other, the plurality of linear portions extending in a horizontal direction of a face plane of the putter face which horizontal direction the face plane is supposed to have at a time of striking the golf ball, the periphery of the protrusion front edge surface forming a racetrack shape (i) which is defined by a pair of the linear portions facing each other and a pair of the curve portions facing each other and (ii) which has a longer diameter of not less than 0.3 mm but not more than 0.5 mm and (ii) a shorter diameter of not less than 0.1 mm but not more than 0.2 mm.

With the above arrangement, it is possible to efficiently create topspin on the golf ball.

Additional objects, features, and strengths of the present invention will be made clear by the description below. Further, the advantages of the present invention will be evident from the following explanation in reference to the drawings.

BRIEF DESCRIPTION OF DRAWINGS

FIG. 8 illustrates results of the friction test.

DESCRIPTION OF EMBODIMENTS

One embodiment of the present invention is described below with reference to FIG. 1 to FIG. 9.

[1. Arrangement of Putter Face]

With reference to FIG. 1 to FIG. 4, initially explained is an exemplary arrangement of a head part, which is a main part of a golf putter of the present embodiment. The following deals with the head part. The other part of the golf putter of the present embodiment may be arranged in the similar manner to general golf putters, and therefore will not be explained here particularly. Further, a structure and a material of each constituent of the golf putter except for a putter face 2 explained below is not especially limited.

Figure 1:
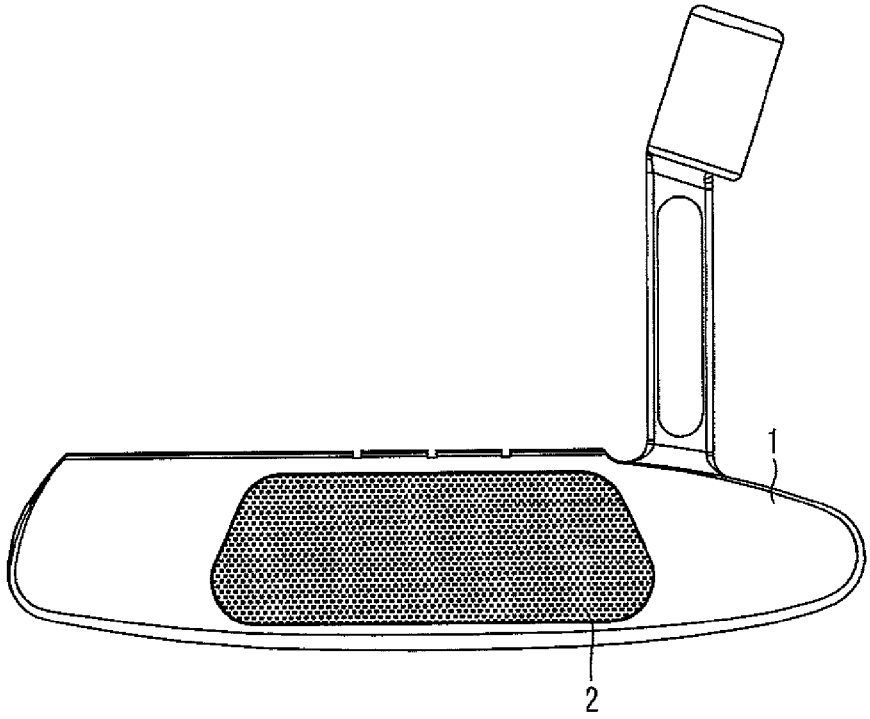
FIG. 1 is a view schematically illustrating an arrangement of a head part of a golf putter in accordance with one embodiment of the preset invention.

FIG. 1 is a view schematically illustrating an arrangement of the head part, which is a main part of the golf putter of the present embodiment.

As illustrated in FIG. 1, the head part, which is a main part of the golf putter of the present embodiment, includes a putter head 1 and a putter face 2. More specifically, the golf putter according to one embodiment of the present invention is arranged such that the putter face 2 is inserted into the putter head 1.

The putter face 2 may be so arranged to be detachable from the putter head 1. This allows a user to play golf with a putter face selected as appropriate from among putter faces having different features. That is, the user can use various putter faces having different features.

How to attach the putter face 2 to the putter head 1 of the golf putter is not especially limited. For example, the putter face 2 may be attached to the putter head 1 by fitting them together with the use of adhesion, welding, friction or the like. The putter face 2 may be colored optionally.

Figure 2:
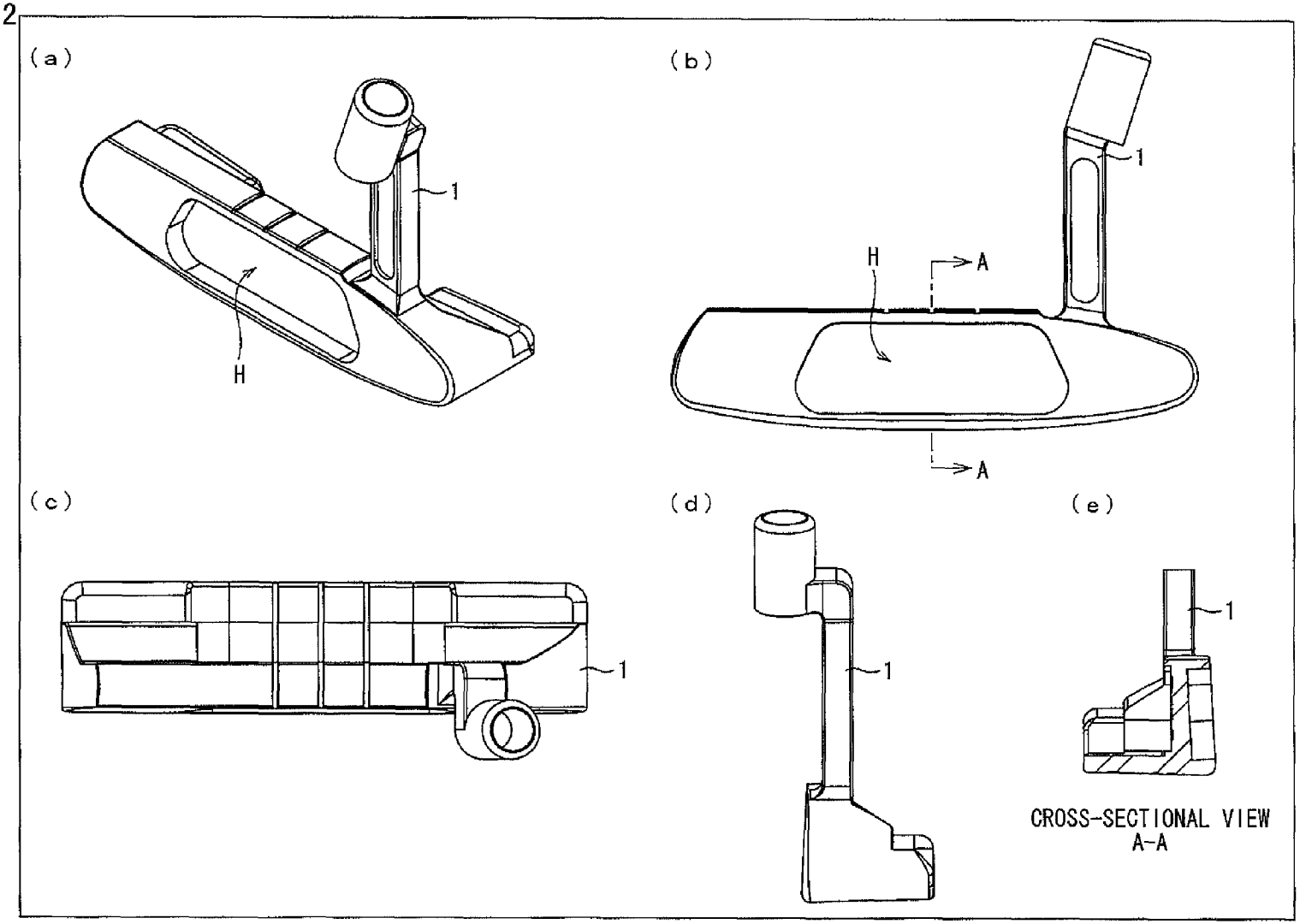
FIG. 2 is structural drawings illustrating an arrangement of a putter head of the golf putter of FIG. 1: (a) of FIG. 2 perspectively illustrates the arrangement of the putter head into which a putter face of the present invention is not inserted; (b) of FIG. 2 illustrates the putter head as viewed from a face-plane side thereof; (c) of FIG. 2 illustrates a top view of the putter head shown in (b) of FIG. 2; (d) of FIG. 2 is a right side view of the putter head shown in (b) of FIG. 2; and (e) of FIG. 2 is a cross-sectional view taken along the line A-A in (b) of FIG. 2.
Figure 3:
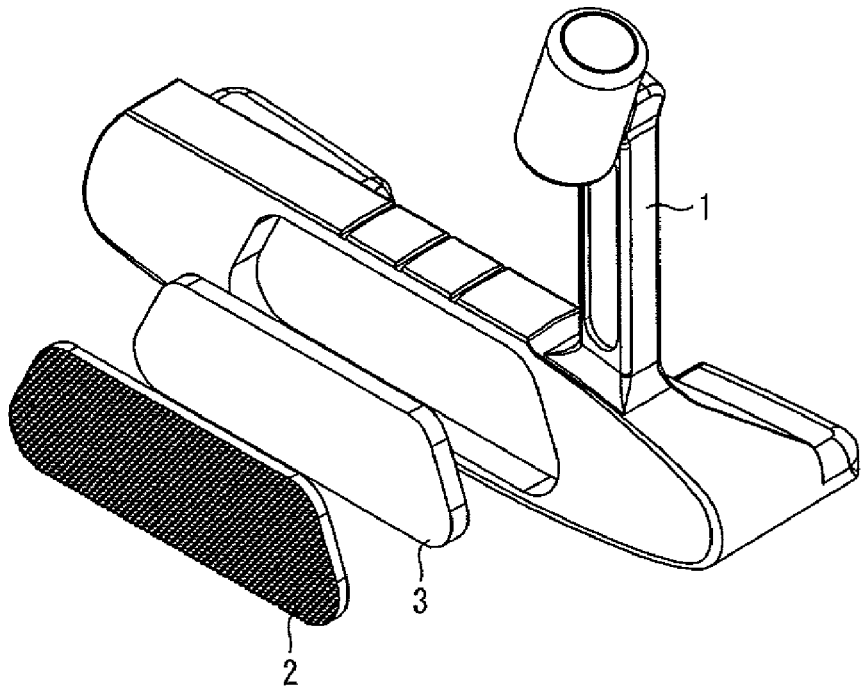
FIG. 3 is a view schematically illustrating how a repulsive elastic member is attached to a backside of the putter face and how the putter face is inserted into the putter head.
Figure 4:
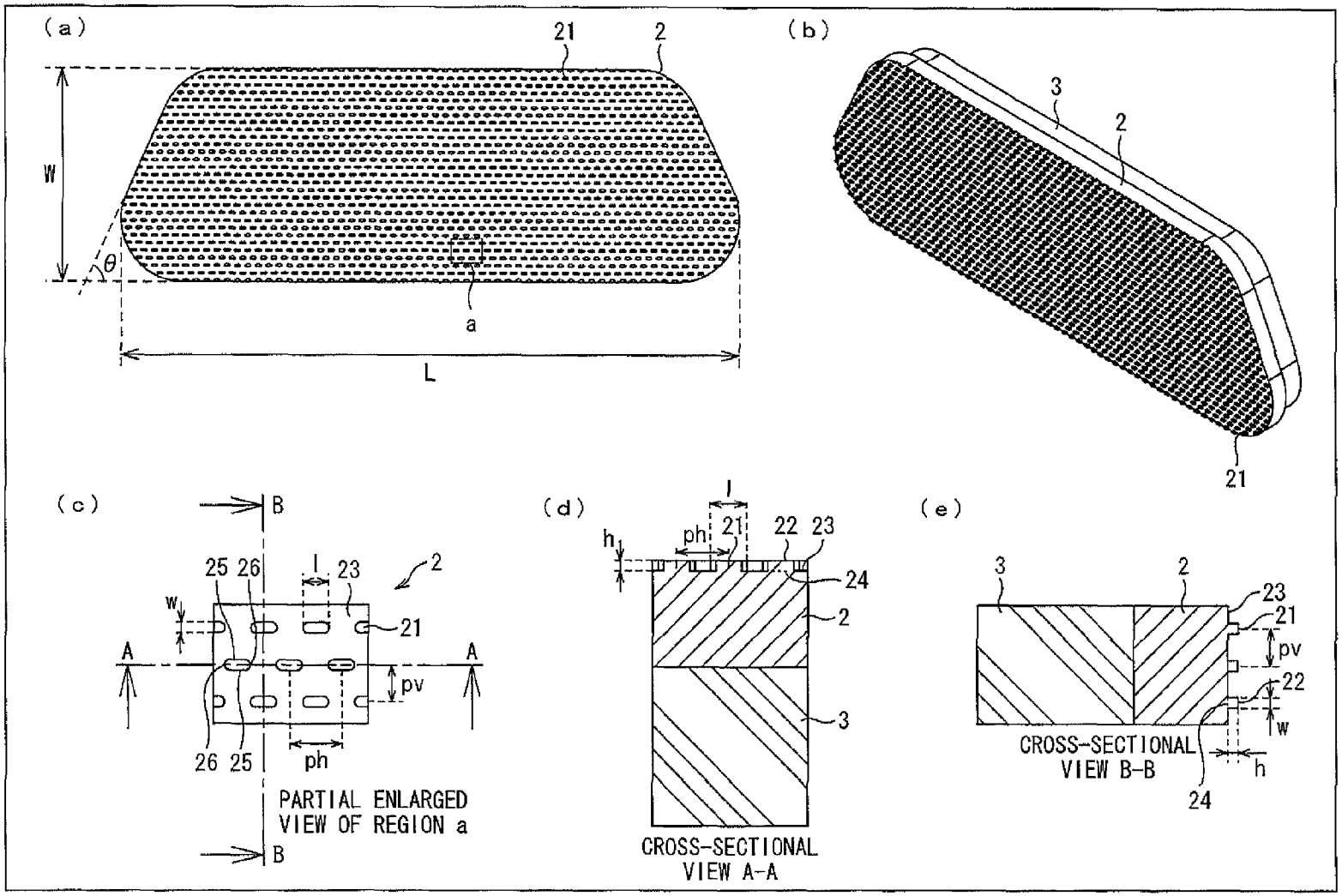
FIG. 4 is structural drawings each illustrating an arrangement of the putter face: (a) of FIG. 4 illustrates the putter face as viewed from the face plane side; (b) of FIG. 4 perspectively illustrates the arrangement of the putter face; (c) of FIG. 4 is an enlarged view partially illustrating a region a of the putter face of (a) of FIG. 4; (d) of FIG. 4 is a cross-sectional view taken along the line A-A in (c) of FIG. 4; and (e) of FIG. 4 is a cross-sectional view taken along the line B-B in (c) of FIG. 4.

With reference to FIG. 2, FIG. 3, and (a) of FIG. 4 to (e) of FIG. 4, the following explains more details of structures of the putter head 1 and the putter face 2, which constitute the head part of the present embodiment.

FIG. 2 is structural drawings illustrating an arrangement of the putter head 1: (a) of FIG. 2 perspectively illustrates the arrangement of the putter head 1 into which the putter face 2 is not inserted; (b) of FIG. 2 illustrates the putter head 1 as viewed from a side of a face plane thereof; (c) of FIG. 2 is a top view of the putter head 1 shown in (b) of FIG. 2; (d) of FIG. 2 is a right side view of the putter head 1 shown in (b) of FIG. 2; (e) of FIG. 2 is a cross-sectional view taken along the line A-A in (b) of FIG. 2.

The face plane indicates a ball-striking surface, of the putter face 2, which strikes a ball.

As illustrated in (a) and (b) of FIG. 2, on the side of the face plane of the putter head 1, there is an opening H into which the putter face 2 is inserted. The opening H illustrated in (a) and (b) of FIG. 2 has a shape conforming to the putter face 2.

FIG. 3 is a view schematically illustrating how a repulsive elastic member 3 is attached to a backside of the putter face 2 and how the putter face 2 is inserted into the putter head 1.

The putter face 2 may be inserted into the opening H of the putter head 1 in such a manner that the repulsive elastic member 3, which is made from urethane rubber, is attached to a backside (i.e., a side opposite to the face plane, in the putter face 2) of the putter face 2, which backside is opposite to another side of the putter face 2 on which microscopic protrusions 21 and recessed bottom face 23 are provided (see FIG. 3). In this case, the putter head 1 is arranged such that the putter head 1 and the putter face 2 sandwich the repulsive elastic member 3.

The urethane rubber is synthetic rubber mainly containing polyurethane, which is a polymer having a urethane bond (—NHCOO—) in a main chain. Note that the material of the repulsive elastic member 3, except for the urethane rubber, may be nitrile rubber, chloroprene rubber, ethylene rubber, butyl rubber, fluoro-rubber, silicon rubber, or the like, for example.

In such an arrangement that the repulsive elastic member 3 is provided, the repulsive elastic member 3 functions as a cushion when the ball is struck. This contributes to an increase in contact time (dwell time), during which the putter face 2 has contact with a golf ball 7. This allows the golf putter to more easily put spin on the golf ball. As a result, a golf player using the golf putter can get a better feel through the golf putter. Further, assume that the putter face 2 is attached to the golf putter in a detachable manner, for example. In this case, the golf putter is excellent in terms of ease of maintenance (e.g., dust can be easily removed). In addition, the player can play golf with a putter face selected as appropriate from among the putter faces having different features. That is, the player can choose a putter face having an intended feature, as appropriate.

FIG. 4 is structural drawings each illustrating the arrangement of the putter face 2. (a) of FIG. 4 illustrates the putter face 2 viewed from the side of the face plane; (b) of FIG. 4 perspectively illustrates the arrangement of the putter face 2; (c) of FIG. 4 is an enlarged view partially illustrating a region a in the putter face 2 of (a) of FIG. 4; (d) of FIG. 4 is a cross-sectional view taken along the line A-A in (c) of FIG. 4; and (e) of FIG. 4 is a cross-sectional view taken along the line B-B in (c) of FIG. 4.

As illustrated in (a) and (b) of FIG. 4, the putter face 2 is provided with a plurality of microscopic protrusions 21.

The plurality of microscopic protrusions 21 are arranged so as to form a plurality of rows in each of which the microscopic protrusions 21 are aligned straight along the same axis in a horizontal direction (a longitudinal direction of a sheet of paper on which (a) of FIG. 4 is depicted). Further, in the plurality of rows, the plurality of microscopic protrusions 21 are aligned alternately in staggered positions in a vertical direction (a lateral direction of a sheet of paper on which (a) of FIG. 4 is depicted). Moreover, the putter face 2 illustrated in (a) of FIG. 4 is about 59.4 mm in lateral length L and about 19.8 mm in vertical length W. However, the dimension of the putter face 2 is not limited provided that the putter face 2 is housed in the putter head 1.

The following describes a structure of the microscopic protrusion 21 and how the plurality of microscopic protrusions 21 are aligned on the face plane of the putter face 2, with reference to (c) to (e) of FIG. 4.

As illustrated in (c) to (e) of FIG. 4, the face plane of the putter face 2 has a recessed bottom face (hereinafter, referred to as "recessed bottom face 23") between the plurality of microscopic protrusions 21. Further, each of the microscopic protrusions 21 has a planar end portion (hereinafter, referred to as "protrusion front edge surface 22". A cut plane of a bottom of the microscopic protrusion 21, which is another end opposite to the protrusion front edge surface 22, is referred to as a protrusion bottom cut plane 24.

As described above, it is said that the most important element in the ball controllability of the golf putter is how easily the golf putter creates topspin on the golf ball 7 in a vertical direction of the face plane.

Even if a golf putter is not improved in overall ball controllability, such as easiness of putting spin on the golf ball 7 in various directions, it can be said that the golf putter has a sufficient performance, as long as the ball controllability of the golf putter is improved in terms of easily creating topspin on the golf ball 7 in the vertical direction.

From this viewpoint, as illustrated in (c) of FIG. 4, the protrusion front edge surface 22 has a periphery in a shape of a racetrack including a pair of line segments (linear portions 25) facing each other and a pair of substantially semicircular curve portions 26 facing each other. The shape of the protrusion front edge surface 22 is not limited to such a racetrack shape, provided that the protrusion front edge surface 22 has a periphery including a plurality of linear portions facing each other, and a plurality of curve portions facing each other. Modified examples of the shape of the protrusion front edge surface 22 will be described later.

Further, each of the microscopic protrusions 21 is arranged such that the pair of linear portions 25 of the protrusion front edge surface 22 are aligned along a horizontal direction of the face plane. That is, the linear portions 25 of the protrusion front edge surface 22 extend in the horizontal direction of the face plane which horizontal direction the face plane is supposed to have at a time of striking a ball.

The "horizontal direction of the face plane which horizontal direction the face plane is supposed to have at a time of striking a ball" is a direction (a) which is parallel to a ground surface on which the ball is placed, at the time when the golf putter strikes the ball, and (b) which is perpendicular to a ball-striking direction along which the ball is struck. Details of the horizontal direction of the face plane will be explained later based on the drawings.

On the other hand, the "vertical direction of the face plane" is a direction which is vertical to both the horizontal direction of the face plane and the ball-striking direction, at the time when the golf putter strikes the ball.

Such a unique structure of the face plane of the putter face 2 according to the present embodiment is formed by use of a half-etching method in which one side of a plate-like object to be processed made from a given material is etched to a certain thickness by use of a chemical. The material of the putter face 2 will be described later.

Moreover, the putter face 2 of the present embodiment is provided for use in the golf putter as an independent member separated from the putter head 1 and is inserted into the opening H provided on a striking-plane side of the putter head 1, by which side the putter head 1 strikes the golf ball 7. However, the present invention is not limited to such an embodiment.

For example, the putter face 2 may be formed by a direct half-etching method on a striking-plane side of a metallic putter head 1 in an integrated manner. The striking-plane side of the metallic putter head 1 is a side by which the metallic putter head 1 strikes the golf ball 7.

With reference to (c) to (e) of FIG. 4, the following describes a size of each of the constituents and a pitch (interval) between closest microscopic protrusions 21.

Initially, as illustrated in (c) and (d) of FIG. 4, a maximum length (hereinafter, referred to as "longer diameter 1") of the protrusion front edge surface 22 in the horizontal direction is about 0.5 mm. Further, as illustrated in (c) and (e) of FIG. 4, a maximum length (hereinafter, referred to as "shorter diameter w") thereof in the vertical direction is about 0.2 mm.

The longer diameter 1 and the shorter diameter w are not limited to the above values. However, the longer diameter 1 is preferably not less than about 0.3 mm but not more than about 0.5 mm, and the shorter diameter w is preferably not less than about 0.1 mm but not more than about 0.2 mm. Further, it is preferable that the longer diameter 1 be set longer than the shorter diameter w.

One of the reasons is as follows: In a case where the longer diameter 1 of the protrusion front edge surface 22 is less than about 0.3 mm, the microscopic protrusion 21 becomes too small in size, thereby resulting in that a drag force (grip effect) exerted on the golf ball 7 is rather small and a static frictional force is reduced. As a result, it is difficult to obtain a sufficient rolling force.

Further, an interval between dimples of the golf ball 7 is about 0.51 mm, assuming that the golf ball 7 includes 300 to 400 dimples, which is a general dimple number. On this account, in a case where the longer diameter 1 of the protrusion front edge surface 22 exceeds about 0.5 mm, the size of the microscopic protrusion 21 is larger than the interval between the dimples of the golf ball 7. This makes it difficult for the racetrack-shaped curve portion 26 to have contact with a spherical surface between the dimples on a surface of the golf ball 7. As a result, the drag force of the microscopic protrusion 21 exerted on the golf ball 7 is hardly obtained in the horizontal direction. This markedly reduces the static frictional force in the horizontal direction and renders the ball controllability worse.

Further, in a case where the shorter diameter w of the protrusion front edge surface 22 is less than 0.1 mm, it is difficult to produce the putter face 2 by the half-etching method.

On the other hand, in a case where the shorter diameter w of the protrusion front edge surface 22 exceeds 0.2 mm, a distance between the linear portions 25 of the protrusion front edge surface 22 is too large. This prevents the microscopic protrusions 21 from biting into the ball surface. As a result, the static frictional force in the vertical direction is reduced, thereby rendering the ball controllability worse.

The microscopic protrusion 22 has a height (hereinafter, referred to as a microscopic-protrusion height) h of about 0.2 mm, where the microscopic-protrusion height h is a distance between the protrusion front edge surface 22 and the protrusion bottom cut plane 24.

The microscopic-protrusion height h is not especially limited to the above value. However, the microscopic-protrusion height h is preferably not less than about 0.1 mm but not more than about 0.2 mm.

The reason is as follows: in a case where the microscopic-protrusion height h is less than about 0.1 mm, a degree of unevenness on the face plane becomes extremely small and therefore the function of the putter face 2 is not so different from that of a planar putter face. As a result, the microscopic protrusions 21 do not bite into the surface of the golf ball 7 so much at the time of striking the golf ball 7. This inversely reduces the static frictional force exerted on the golf ball 7 from the putter face 2, so that a sufficient rolling force cannot be obtained.

On the other hand, in a case where the microscopic-protrusion height h exceeds about 0.2 mm, even if the microscopic protrusions 21 bite into the surface of the golf ball 7 so sufficiently that a contact portion to the putter face 2 on the surface of the golf ball 7 is deformed, a side surface of the microscopic protrusion 21 and the recessed bottom face 23 cannot make additional contact with the surface of the golf ball 7. This makes it difficult to cause an additional frictional force. As a result, it is rather difficult to create spin on the golf ball 7 sufficiently. Further, in the case where the microscopic-protrusion height h exceeds about 0.2 mm, it is difficult to process the microscopic protrusions 21 at given intervals, by the half-etching method.

The plurality of microscopic protrusions 21 are aligned such that a vertical-direction pitch (hereinafter, referred to a first pitch pv) between rows of the microscopic protrusions 21 is about 0.7 mm and a horizontal-direction pitch (hereinafter, referred to as a second pitch ph) between the microscopic protrusions 21 is about 1.0 mm. Further, a minimum distance between the microscopic protrusions 21 in the vertical direction is equal to a difference between the first pitch pv and the shorter diameter w, and a minimum distance between the microscopic protrusions 21 in the horizontal direction is equal to a difference between the second pitch ph and the longer diameter 1. Either of the minimum distances in the vertical and horizontal directions is about 0.5 mm.

The first pitch pv and the second pitch ph are not limited to the above value. However, it is preferable that the microscopic protrusions 21 be aligned at regular intervals such that the second pitch ph is longer than the first pitch pv.

The reason is as follows: when the microscopic protrusions 21 are provided more thickly in the vertical direction of the face plane than in the horizontal direction of the face plane, the static frictional force of the putter face 2 in the vertical direction becomes larger than the static frictional force thereof in the horizontal direction. This makes it possible to easily obtain a rolling force in a forward direction and to restrain a rolling force in non-forward directions. Further, with the above arrangement, it is possible to enhance the rolling force on the golf ball 7 in the forward direction, thereby improving the ball controllability.

Moreover, the minimum distance between the microscopic protrusions 21 adjacent to each other is preferably (i) not less than about 0.2 mm but not more than about 0.5 mm for the vertical direction of the putter face 2 and (ii) not less than about 0.2 mm but not more than about 0.5 mm for the horizontal direction of the putter face 2.

The reason is as follows: in a case where the minimum distance between the microscopic protrusions is less than about 0.2 mm, the microscopic protrusions 21 do not bite into the surface of the golf ball 7 sufficiently enough to deform the contact portion of the surface of the golf ball 7, which contact portion makes contact with the putter face 2. This is because the distance between the microscopic protrusions 21 is too narrow and therefore the side surface of the microscopic protrusion 21 and the recessed bottom face 23 cannot make additional contact with the surface of golf ball 7. As a result, the static frictional force occurring between the putter face 2 and the golf ball 7 decreases, thereby making it difficult to obtain the rolling force sufficiently.

On the other hand, in a case where the minimum distance between the microscopic protrusions 21 exceeds about 0.5 mm, the number of microscopic protrusions 21 formed per unit area of the putter face 2 is small. As a result, a less number of microscopic protrusions 21 bite into the golf ball 7, thereby resulting in that the static frictional force occurring between the putter face 2 and the golf ball 7 is reduced. This makes it difficult to obtain the rolling force sufficiently.

Further, a density of the microscopic protrusions 21 formed per unit area of the putter face 2 is preferably not less than 100 pieces/$cm^2$ but not more than 670 pieces/$cm^2$.

The reason is as follows: in a case where the density of the microscopic protrusions 21 is less than 100 pieces/$cm^2$, the number of microscopic protrusions 21 formed per unit area of the putter face 2 is small. Therefore, the number of microscopic protrusions 21 that make contact with the golf ball 7 when the golf ball 7 is struck is also small. As a result, a total sum of the drag force exerted on the golf ball 7 becomes small and the static frictional force exerted on the golf ball 7 from the putter face 2 is reduced. Consequently, it is difficult to obtain the rolling force sufficiently. Further, since there are large gap spaces between the microscopic protrusions 21, foreign substances may be attached to the gap spaces.

On the other hand, in a case where the density of the microscopic protrusions 21 exceeds 670 pieces/$cm^2$, the degree of unevenness on the surface of the putter face 2 becomes so small that the function thereof is not so different from that of the planar putter face. This prevents the microscopic protrusions 21 from biting into the golf ball 7, thereby inversely reducing the static frictional force occurring between the putter face 2 and the golf ball 7. Consequently, it is difficult to obtain the rolling force sufficiently.

[2. Constituent Material of Putter Face]

Explained next is a constituent material and the like of the putter face 2, with reference to (a) of FIG. 4 to (b) of FIG. 7.

The arrangements of the putter face 2, except for the arrangement to be explained in [2. Constituent Material of Putter Face], are the same as the arrangements that have been already explained in [1. Arrangement of Putter Face]. Further, members of the putter face 2 having the like functions as the members shown in the drawings explained in [1. Arrangement of Putter Face] have the like reference numbers as in the drawings thus explained above, and are not explained here.

The putter face 2 of the present embodiment is made from stainless. The material of the putter face 2 is not limited to the stainless, but is preferably a metallic material which is suitably applicable to the aforementioned etching process and which has stiffness higher than that of a synthetic resin generally used for a surface of a golf ball, such as thermoplastic polyurethane elastomer obtained by causing polyester or polyether to react with isocyanate.

In addition to the stainless, examples of the material of the putter face 2 encompass iron, copper, 42 alloy (42 Ni—Fe alloy), kovar (KOV), nickel, brass, permalloy, metal amorphous, and the like materials.

As the examples described above, it is preferable that the putter face 2 be made from the material having high stiffness. The reason is as follows: the material having high stiffness allows the putter face 2 to sufficiently bite into the surface of the golf ball 7 at the time of striking the golf ball 7, thereby causing a large drag force to be exerted on the golf ball 7 from the putter face 2. Further, when the putter face 2 bites into the golf ball 7, the golf ball 7 is deformed as described above. The golf ball 7 thus deformed additionally makes contact with the recessed bottom face 23 so that the golf ball 7 receives an additional frictional force at its contact portion at which the golf ball 7 contacts with the recessed bottom face 23.

As a result, the frictional force occurring between the putter face 2 and the golf ball 7 increases, thereby causing the rolling force to be sufficiently exerted on the golf ball 7.

Further, in the above arrangement, the putter face 2 has the stiffness higher than that of the golf ball 7.

This yields such an advantage that the putter face 2 has a large coefficient of restitution as compared with a non-metallic putter face, and therefore causes small loss of an initial rate and energy of the golf ball 7.

[3. Rolling Force Added to Golf Ball at Time of Striking Golf Ball]

Figure 5:
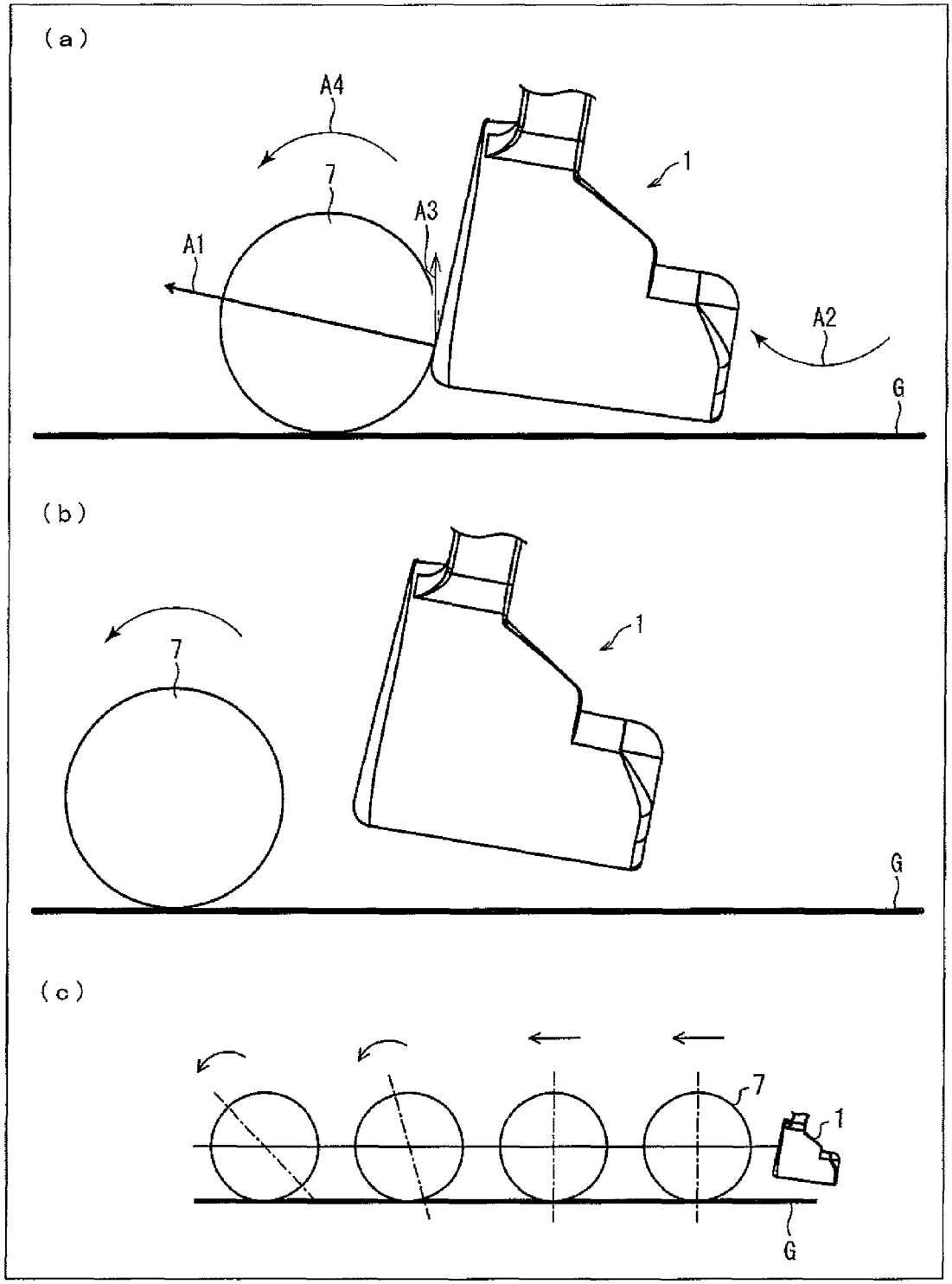
FIG. 5 is conceptual diagrams illustrating a function of the putter face (putter head): (a) of FIG. 5 is a side view schematically illustrating a moment when the putter head strikes a golf ball; (b) of FIG. 5 is a side view schematically illustrating how the golf ball with topspin rolls away from the putter head right after being struck; and (c) of FIG. 5 is a side view schematically illustrating how the golf ball struck by the putter head rolls forward.

With reference to FIG. 5, the following explains about the rolling force that is added to the golf ball 7 at the time when the putter head 1 to which the putter face 2 is attached strikes the golf ball 7.

The arrangements of the putter face 2, except for the arrangement to be explained in [3. Rolling Force Added to Golf Ball At Time of Striking Golf Ball], are the same as the arrangements that have been already explained in [1. Arrangement of Putter Face] and [2. Constituent Material of Putter Face]. Further, members of the putter face 2 having the like functions as the members shown in the drawings explained in [1. Arrangement of Putter Face] and [2. Constituent Material of Putter Face] have the like reference numbers as in the drawings thus explained above. Therefore, these members are not explained here repeatedly. In addition, it should be noted that this notation is also applied to the following items where this notation is omitted in order to save the trouble to repeat this notation.

FIG. 5 is conceptual diagrams illustrating a function of the putter face 2 (the putter head 1): (a) of FIG. 5 is a side view schematically illustrating a moment when the putter head strikes a golf ball; (b) of FIG. 5 is a side view schematically illustrating how the golf ball with topspin rolls away from the putter head right after being struck; and (c) of FIG. 5 is a side view schematically illustrating how the golf ball struck by the putter head rolls forward.

When the putter head 1 strikes the golf ball 7 placed on a ground surface G in a striking direction (indicated by an arrow A1) according to a substantial pendular motion, the putter head 1 moves not only to push the golf ball 7 forward but also to rub the golf ball 7 in a vertical upward direction. More specifically, the motion of the putter head 1 is such that after passing a lowest point, the putter head 1 orbits upward around an arch (an arrow A2) centered at a grip portion of a player.

As a result, on a contact plane where the putter head 1 has contact with the golf ball 7, a static frictional force in a vertical upward direction (indicated by an arrow A3) is added to the golf ball 7 and a rolling force in a forward direction (indicated by an arrow A4) is accordingly added to the golf ball 7 (see (a) of FIG. 5). This causes the golf ball 7 to roll over toward a direction that the player intends. Ultimately, the golf ball 7 on which the rolling force is exerted in the forward direction rolls forward (see (b) and (c) of FIG. 5).

When the putter head 1 exerts on the golf ball 7 a large static frictional force in directions other than the vertical upward direction at the time of striking the golf ball 7, the golf ball 7 is given spin in a non-forward direction and rolls over toward an unintended direction.

Further, as have been already described, the pair of the linear portions 25, which is a part of the periphery of the protrusion front edge surface 22, extend in the horizontal direction of the face plane which horizontal direction the face plane is supposed to have at the time of striking the golf ball 7. Here, the horizontal direction of the face plane is a direction which is, at the moment when the putter head 1 strikes the golf ball 7, (i) parallel to the ground surface G, on which the golf ball 7 is placed, and (ii) vertical to the ball-striking direction A1 (see (a) of FIG. 5).

On the other hand, the vertical direction of the face plane is a direction (i) which is vertical to both the horizontal direction of the face plane and the ball striking direction A1 at the moment when the putter head 1 strikes the golf ball 7 and (ii) which is identical to the direction indicated by the arrow A3.

The following describes reasons why the use of the putter face 2 makes it easy to cause the static frictional force in the vertical upper direction and restrains the static frictional force in directions other than the vertical upper direction.

[4. Drag Force Exerted on Golf Ball by Microscopic Protrusions at Time of Striking Golf Ball]

Figure 6:
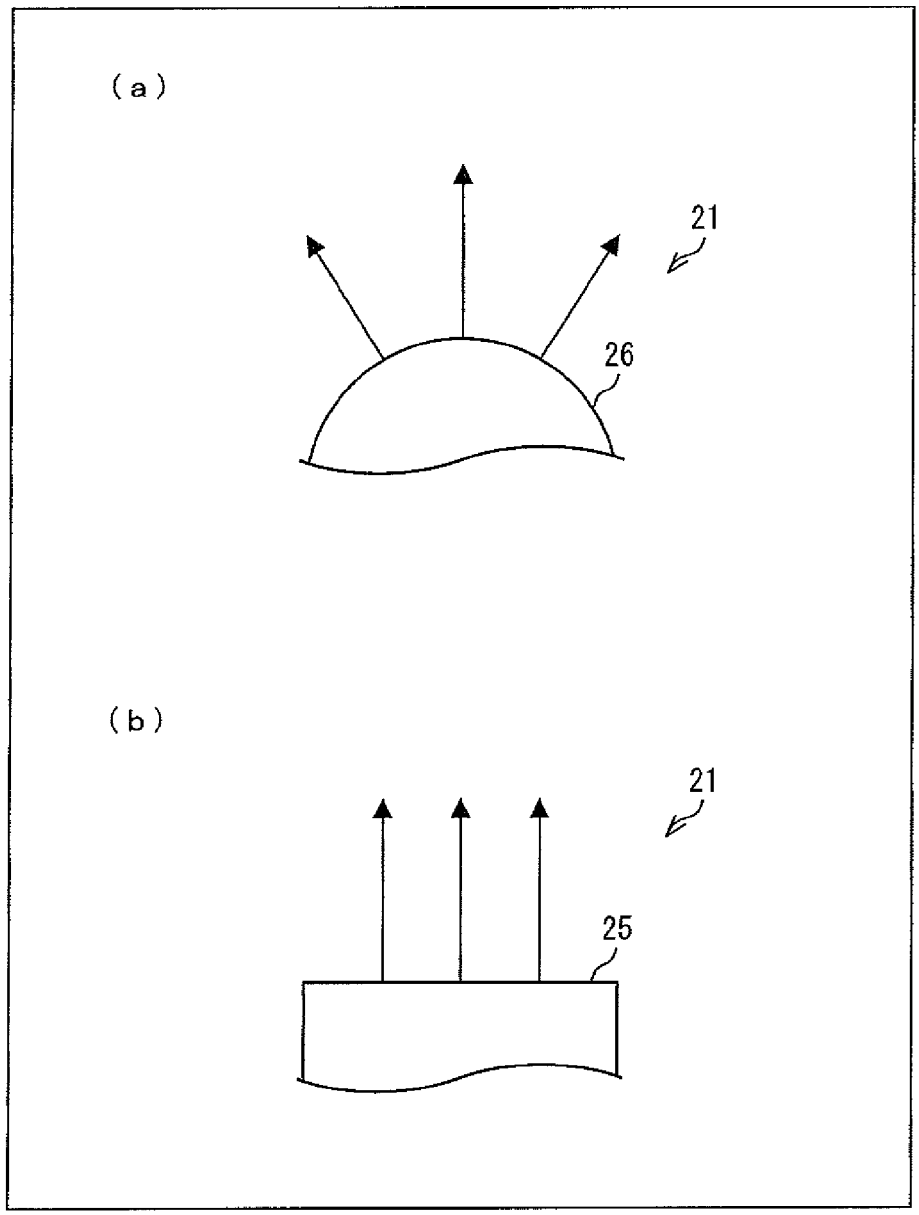
FIG. 6 is conceptual diagrams illustrating directions of a drag force exerted on a golf ball: (a) of FIG. 6 illustrates directions of the drag force exerted on the golf ball from a curve portion of a periphery of a protrusion front edge surface; and (b) of FIG. 6 illustrates directions of the drag force exerted on the golf ball from a linear portion of a periphery of the protrusion front edge surface.

With reference to FIG. 6, explained next is how the microscopic protrusions 21 exert a drag force on the golf ball 7 at the time when the golf putter to which the putter face 2 is attached strikes the golf ball 7.

FIG. 6 is conceptual diagrams illustrating directions of a drag force exerted on the golf ball 7: (a) of FIG. 6 illustrates directions of the drag force exerted on the golf ball from the curve portion 26 of the periphery of the protrusion front edge surface 22; and (b) of FIG. 6 illustrates directions of the drag force exerted on the golf ball from the linear portion 25 of the periphery of the protrusion front edge surface 22.

When the putter face 2 strikes the golf ball 7, a drag force is exerted on the golf ball along normal line directions of the periphery of the protrusion front edge surface 22. That is, on the curve portion 26, the drag force is distributed into multiple directions as illustrated in (a) of FIG. 6. In contrast, on the linear portion 25, the drag force is exerted along one direction of the face plane, as illustrated in (b) of FIG. 6.

That is, when the golf ball 7 is struck, the drag force that the linear portion 25 exerts on the golf ball 7 is uniformly exerted along a normal line direction of the linear portion 25 (i.e., the vertical direction of the face plane). On the other hand, the drag force that the curve portion 26 exerts on the golf ball 7 is exerted along normal line directions of the curve portion 26. Therefore, the drag force is not uniformly exerted along the horizontal direction of the face plane, but is distributed into multiple directions. This results in that the drag force is smaller in the horizontal direction. Accordingly, a vertical component of the static frictional force exerted on the golf ball 7 from the microscopic protrusions 21 at the time of striking the golf ball 7 becomes larger than a horizontal component of the static frictional force.

In this way, the putter face 2 arranged as such can create topspin on the golf ball 7 efficiently.

[5. Evaluation on Effects of Putter Face]

With reference to (a) of FIG. 7, the following explains about a test (hereinafter, referred to as a friction test) for measuring a friction coefficient between a golf ball 7 and an exemplary putter face 2 (hereinafter, referred to as the putter face 2 of Example). The constituent material of the putter face 2 of Example is stainless, as described above.

Figure 7:
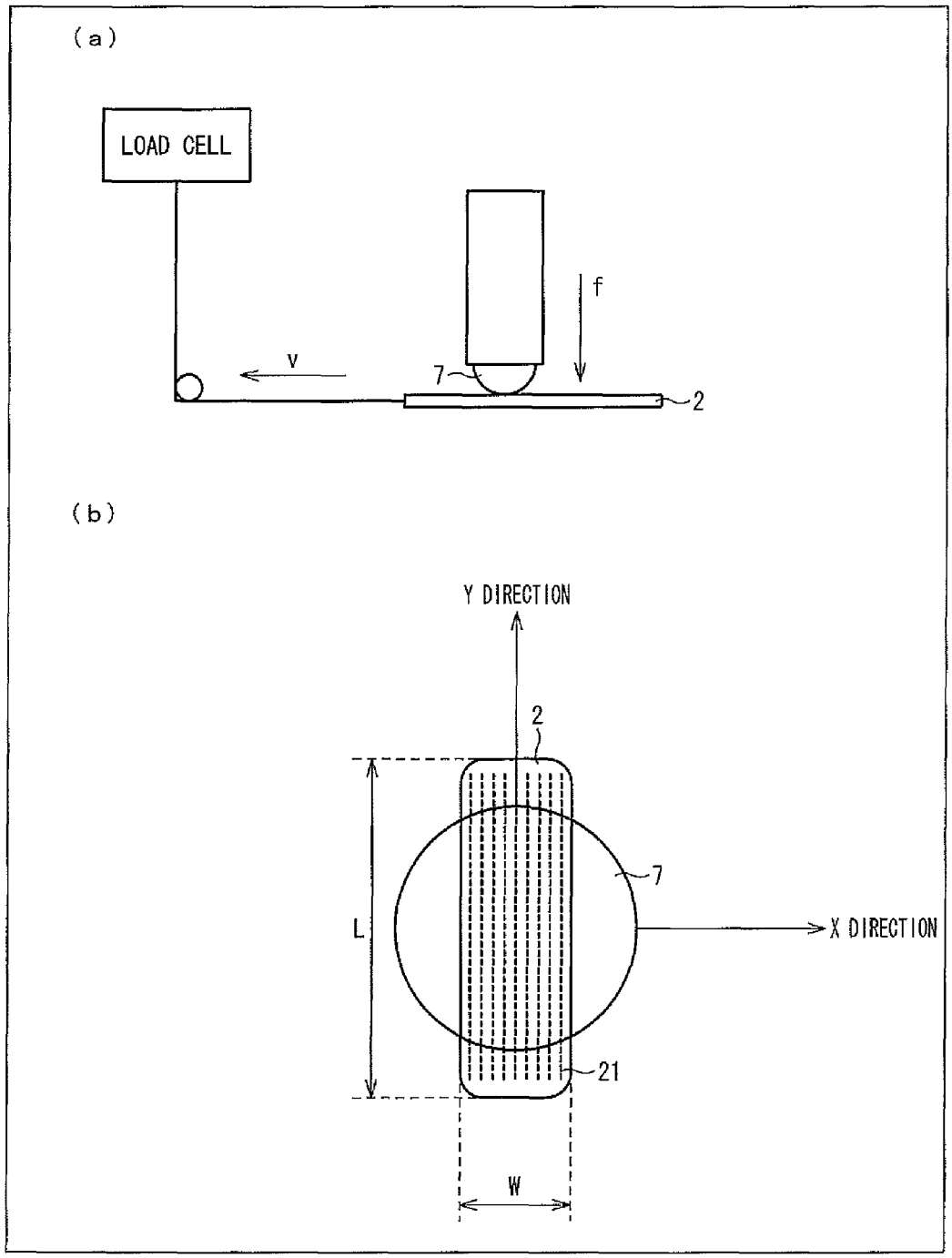
FIG. 7 is explanatory views illustrating how to conduct a friction test for measuring a friction coefficient between a putter face and a golf ball: (a) of FIG. 7 illustrates how to conduct the friction test; and (b) of FIG. 7 illustrates a face plane of the putter face and the golf ball as viewed from just above the putter face in the friction test.

(a) of FIG. 7 illustrates how to conduct the friction test between the putter face 2 of Example and the golf ball 7. A measurement device used here is HEIDON-14S/D, which is a heidon surface property tester (made by SHINTO Scientific co., ltd.)

The friction test is carried out in accordance with the following principle. That is, the putter face 2 of Example and the golf ball 7 are slid at a given velocity v while a load f is being applied between the putter face 2 of Example and the golf ball 7 (see (a) of FIG. 7). A load cell strains the putter face 2 of Example at the velocity v via a pulley and measures a tensile load.

Then, a friction coefficient between the putter face of Example and the golf ball 7 is found from a relationship between the measured tensile load and the load f. At this time, a static friction coefficient can be also found from a tensile load measured at the beginning of sliding of the putter face 2 of Example. In the friction test of the present example, the load f is 200 gw (gram-weight) and the velocity v is 100 mm/min.

Note, however, that the frictional force occurs not only between the putter face 2 of Example and the golf ball 7 but also between the putter face 2 of Example and a table (not shown) on which to place the putter face 2 of Example. Therefore, it is necessary to cancel the friction force occurring between the table and the putter face 2 of Example. In view of this, such a method can be taken that: (i) a tensile load only on the putter face 2 of Example is measured by the load cell in such a manner that, without setting the golf ball 7, the putter face 2 of Example is slid on the table while the load f is being applied thereto; (ii) then, the tensile load thus measured without the golf ball 7 is deducted from the tensile load measured with the golf ball 7 being set. Thus, the friction force occurring between the table and the putter face 2 of Example can be canceled.

(b) of FIG. 7 illustrates the putter face 2 of Example and the golf ball 7 as viewed from just above the putter face 2 of Example in the friction test. An X direction in (b) of FIG. 7 is a vertical direction (width direction) of the putter face 2 of Example at the time of striking the golf ball 7 and a direction of the shorter diameter of the microscopic protrusion 21. Further, a Y direction in (b) of FIG. 7 is a horizontal direction (longitudinal direction) of the putter face 2 of Example at the time of striking the golf ball 7 and a direction of the longer diameter of the microscopic protrusion 21.

Further, for comparison with the putter face 2 of Example, three types of putter faces were prepared, respectively made from polyacetal (POM: Comparative Example 1), polyethylene (PE: Comparative Example 2), and polybutylene terephthalate (PBT: Comparative Example 3). Each of them had grooves extending in the Y direction and having a width of 0.3 mm and a depth of 0.15 mm. These putter faces of the comparative examples were subjected to the friction test under the same conditions. Further, another putter faces were prepared respectively from the material of the putter face 2 of Example and from the material of the putter face of Comparative Example 1, so as to have a plane surface having no microscopic protrusion 21, no groove, or no protrusion. Each of the another putter faces of Example and Comparative Example 1 was also subjected to the friction test to measure a friction coefficient between the plane surface and the golf ball 7, for comparison.

FIG. 8 shows measurement results of the friction tests. In FIG. 8, the measurement result of each of Example and Comparative Examples shows a static friction coefficient and a dynamic friction coefficient for each of the following two cases: (i) a case where the putter face 2 is slid in the X direction; and (ii) a case where the putter face 2 is slid in the Y direction.

In FIG. 8, a putter face made from stainless and having a surface having microscopic protrusions is the putter face 2 of Example. It is shown in FIG. 8 that the putter face 2 of Example has (i) a static friction coefficient of 0.280 in the X direction, which is the horizontal direction of the face plane of the putter face 2 and (ii) a static friction coefficient of 0.210 in the Y direction, which is the vertical direction of the face plane of the putter face 2. From this result, it is demonstrated that the putter face 2 of Example has a larger static friction coefficient in the X direction than in the Y direction, that is, the static frictional force in the vertical direction of the face plane is larger than the static frictional force in the horizontal direction of the face plane.

Further, in regard to the putter face which is, as a comparative example, made from the same stainless as the putter face 2 of Example and having a plane surface, a static friction coefficient between the plane surface and the golf ball 7 is 0.120. That is, it is found that the provision of the microscopic protrusions 21 allows the putter face 2 to have a larger static friction coefficient than that of the putter face having no microscopic protrusion.

Further, it is shown that the putter face of Comparative Example 1 has a static friction coefficient of 0.165, the putter face of Comparative Example 2 has a static friction coefficient of 0.140, and the putter face of Comparative Example 3 has a static friction coefficient of 0.130. That is, they have larger static friction coefficients than that of the putter face made from stainless and having a plane surface. However, it is apparent that the putter face 2 of Example having a plurality of microscopic protrusions 21 has a larger static friction coefficient than those of the putter faces made from resin as described above.

As such, the measurement results of the friction tests demonstrate that the putter face 2 of Example can easily and efficiently put spin on a ball, especially in a forward direction.

[6. Other Examples]

Next will be explained modified examples of the shape of the protrusion front edge surface 22, with reference to (a) to (e) of FIG. 9.

Figure 9:
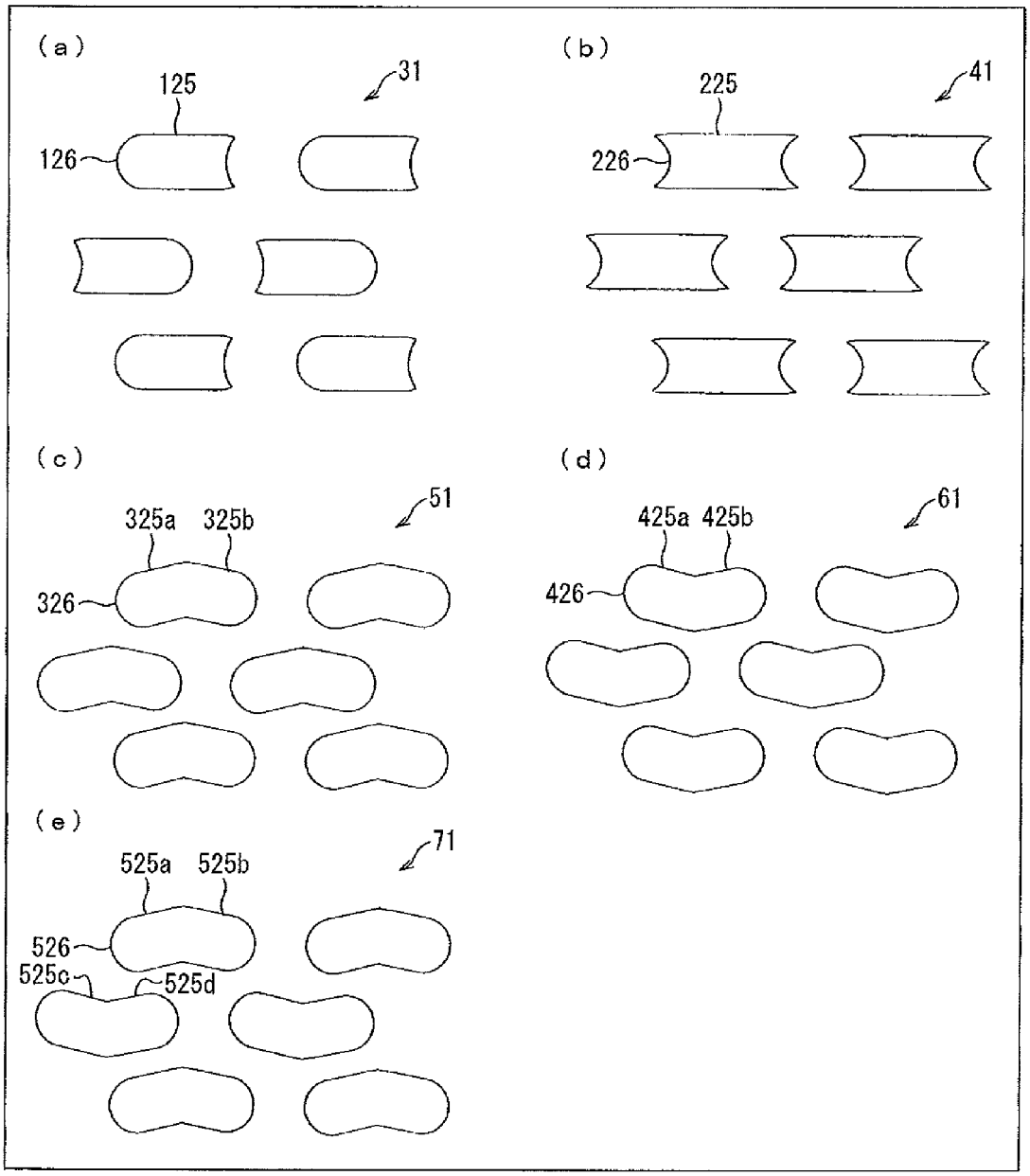
FIG. 9 is schematic views illustrating modified examples of the shape of the protrusion front edge surface: (a) of FIG. 9 illustrates one example of the shape; (b) of FIG. 9 illustrates another example of the shape; and (c) through (e) of FIG. 9 each illustrates still another example of the shape.

(a) to (e) of FIG. 9 are schematic views illustrating modified examples of the shape of the protrusion front edge surface 22.

In the above embodiment, the protrusion front edge surface 22 of the microscopic protrusion 21 provided on the putter face 2 has a racetrack shape. However, the shape of the protrusion front edge surface may be any of the following various shapes constituted by a plurality of linear portions facing each other and a plurality of curve portions facing each other (see (a) to (e) of FIG. 9).

In a microscopic protrusion 31 illustrated in (a) of FIG. 9 as one example of the microscopic protrusion 21, the periphery of the protrusion front edge surface 22 includes a pair of linear portions 125 facing each other and a pair of curve portions 126 each having a shape recessed toward a right direction in (a) of FIG. 9. In a microscopic protrusion 41 illustrated in (b) of FIG. 9 as another example, the periphery of the protrusion front edge surface 22 includes linear portions 225 facing each other and a pair of curve portions 226 facing each other and having a shape recessed toward each other in a lateral direction.

In a microscopic protrusion 51 illustrated in (c) of FIG. 9 as further another example, the periphery of the protrusion front edge surface 22 includes two pairs of linear portions (325*a*, 325*b*) facing each other and a pair of curve portions 326 facing each other, and bends upward (in a steeple-crowned shape). In a microscopic protrusion 61 illustrated in (d) of FIG. 9 as further another example, the periphery of the protrusion front edge surface 22 includes two pairs of linear portions (425*a*, 425*b*) facing each other and a pair of curve portions 426 facing each other, and bends down (in a V shape).

Further, each microscopic protrusion 71 illustrated in (e) of FIG. 9 as still further another example has either the shape of the microscopic protrusion 51 illustrated in (c) of FIG. 9 or the shape of the microscopic protrusion 61 illustrated in (d) of FIG. 9. That is, (i) microscopic protrusions 71 including linear portions 525*a*, linear portions 525*b*, two curve portions 526 facing each other, and (ii) microscopic protrusions 71 including linear portions 525*c*, linear portions 525*d*, two curve portions 526 facing each other are provided in rows in an alternate manner.

In each of the microscopic protrusion 31, the microscopic protrusion 41, the microscopic protrusion 51, the microscopic protrusion 61, and the microscopic protrusion 71, which are exemplified as the microscopic protrusion 21, the periphery of the protrusion front edge surface has a shape that allows a drag force working on a ball, which makes contact with the face plane of the putter face at the time of striking the ball, to be distributed into multiple directions in the horizontal direction of the face plane and to be exerted uniformly in the vertical direction of the face plane.

This makes it possible to efficiently put topspin on the golf ball 7.

Furthermore, the present invention can be expressed as follows.

That is, the putter face of the present invention may be arranged such that each of the plurality of microscopic protrusions has a height of not less than 0.1 mm but not more than 0.2 mm, which height is defined by a distance from the protrusion front edge surface to a protrusion bottom cut plane, which is a cut plane of a bottom section of said each of the plurality of microscopic protrusions.

In a case where the height of the microscopic protrusion (the microscopic-protrusion height) is less than 0.1 mm, the degree of unevenness on the putter face is extremely small so that the function of the putter face of the present invention is not so different from that of a planar putter face. As a result, the microscopic protrusions do not bite into a surface of the golf ball so much at the time of striking the golf ball. This inversely reduces a static frictional force occurring between the putter face and the golf ball, thereby making it difficult to obtain the rolling force sufficiently.

On the other hand, in a case where the microscopic protrusion height exceeds 0.2 mm, the microscopic protrusions bite into the ball surface sufficiently enough to deform a contact portion of the ball surface, which contact portion makes contact with the putter face. However, even in this case, a side surface of the microscopic protrusion and a recessed bottom face between the microscopic protrusions cannot make additional contact with the surface of the golf ball. This makes it rather difficult to create spin on the ball sufficiently. Further, in the case where the microscopic-protrusion height exceeds 0.2 mm, it is difficult to process the microscopic protrusions at given intervals, by the aforementioned half-etching method.

Further, the putter face of the present invention may be arranged such that the plurality of microscopic protrusions are provided such that they are equally distanced from each other at a given first pitch in a vertical direction of the face plane while they are equally distanced from each other at a given second pitch in the horizontal direction of the face plane, which given second pitch is longer than the given first pitch.

In the arrangement, the microscopic protrusions are provided such that they are equally distanced from each other at a given first pitch in the vertical direction while they are equally distanced from each other at a given second pitch in the horizontal direction, which given second pitch is longer than the given first pitch. Thus, the microscopic protrusions are provided more thickly in the vertical direction than in the horizontal direction. This makes it possible to make a static frictional force in the vertical direction of the face plane larger than a static frictional force in the horizontal direction of the face plane. As a result, a rolling force in a forward direction can be easily obtained, and a rolling force in non-forward directions is restrained because it is distributed in multiple directions. Accordingly, the rolling force that puts topspin on the ball is enhanced, thereby improving the ball controllability.

Moreover, the putter face of the present invention may be arranged such that the plurality of microscopic protrusions are adjacent to each other with a minimum distance of not less than 0.2 mm but not more than 0.5 mm in the vertical direction of the face plane, and with a minimum distance of less than 0.2 mm but not more than 0.5 mm in the horizontal direction of the face plane.

In a case where the minimum distance between the microscopic protrusions adjacent to each other is less than 0.2 mm, the microscopic protrusions do not bite into the surface of the golf ball sufficiently enough to deform the contact portion of the surface of the golf ball, which contact portion makes contact with the putter face. This is because the distance between the microscopic protrusions is too narrow, and therefore, the side surface of the microscopic protrusion and a recessed bottom face between the microscopic protrusions cannot make additional contact with the surface of the golf ball 7. As a result, the static frictional force occurring between the putter face and the golf ball decreases, thereby making it difficult to obtain the rolling force sufficiently.

On the other hand, in a case where the minimum distance between the microscopic protrusions adjacent to each other exceeds 0.5 mm, the number of the microscopic protrusions formed per unit area of the putter face is small. As a result, a less number of the microscopic protrusions bite into the golf ball, thereby resulting in that the static frictional force occurring between the putter face and the golf ball is reduced. This makes it difficult to obtain the rolling force sufficiently.

Furthermore, the putter face of the present invention may be arranged such that the plurality of microscopic protrusions are provided with such a density that the number of the microscopic protrusions formed per unit area of the face plane is not less than 100 pieces/cm$^2$ but not more than 670 pieces/cm$^2$.

In a case where the density of the microscopic protrusions is less than 100 pieces/cm$^2$, the number of the microscopic protrusions formed per unit area of the putter face is small. Therefore, the number of the microscopic protrusions that make contact with the golf ball when the golf ball is struck is also small. As a result, a total sum of a drag force exerted on the golf ball becomes small and the static frictional force exerted from the putter face on the golf ball is reduced. Consequently, it is difficult to obtain the rolling force sufficiently. Further, foreign substances may be attached to gap spaces between the microscopic protrusions.

On the other hand, in a case where the density of the microscopic protrusions exceeds 670 pieces/cm$^2$, the degree of unevenness on the surface of the putter face becomes so small that the function thereof is not so different from that of the planar putter face. This reduces the drag force (grip effect) exerted on the ball, thereby inversely reducing the static frictional force. As a result, it is difficult to obtain the rolling force sufficiently.

Further, in the putter face of the present invention, the plurality of microscopic protrusions may be formed by a half-etching method.

Moreover, the putter face of the present invention may be made from one selected from the group consisting of iron, copper, stainless, 42 alloy (42 Ni—Fe alloy), kovar (KOV), nickel, brass, permalloy, and metal amorphous.

Furthermore, a golf putter of the present invention may include the putter face described above; a repulsive elastic member provided so as to face a side of the putter face which side is opposite to the face plane of the putter face; and a putter head provided such that the putter head and the putter face sandwich the repulsive elastic member.

In the arrangement, the repulsive elastic member is provided between the putter face and the putter head so that the repulsive elastic member functions as a cushion at the time of striking the ball. As a result, the arrangement can increase contact time (dwell time) during which the putter head makes contact with the golf ball. This results in that the golf putter gives a better feel to a golf player. Further, assume that the putter face is provided in a detachable manner, for example. In this case, the golf putter is excellent in terms of ease of maintenance (e.g., dust can be easily removed). In addition, the player can play golf by changing the putter face to another one having a different feature, depending on the circumstances. That is, the player can choose a putter face having an intended feature, as appropriate.

Further, a putter face of the present invention is a putter face for use in a golf putter and includes a plurality of microscopic protrusions which have stiffness higher than that of a ball and which are smaller than intervals between dimples of the ball. Each of the plurality of microscopic protrusions has an end having a protrusion front edge surface formed in a planar shape. A periphery of the protrusion front edge surface may have a shape that causes a drag force working on the ball, which makes contact with a face plane of the putter face at the time of striking the ball, to be distributed in multiple directions in a horizontal direction of the face plane but to be uniformly exerted in a vertical direction of the face plane.

With the arrangement, the drag force exerted on the golf ball when the golf ball is struck is uniformly exerted in the vertical direction of the face plane but is distributed in multiple directions in the horizontal direction of the face plane. Accordingly, it is possible to make a vertical component of the static frictional force, which is exerted from the microscopic protrusions on the golf ball at the time of striking the golf ball, larger than a horizontal component of the static frictional force.

As a result, a directivity of the static frictional force to the vertical direction is increased, thereby making it possible to obtain the rolling force in the forward direction more easily and to restrain the rolling force in the non-forward directions, adversely.

Furthermore, by adjusting the number, size, and placement of microscopic protrusions per unit area of the face plane, it is possible to freely adjust the intensity of the static frictional force and the directivity of the static frictional force to the vertical direction.

Consequently, it is possible to efficiently create topspin on the golf ball.

Note that, as have been already described above, the putter face of the present invention is not limited to the one that is provided for use in the golf putter as an independent member separated from the putter head and is inserted into the opening provided on a striking-plane side of the putter head, by which side the putter head strikes the golf ball.

For example, as described above, the putter face of the present invention may be formed, by the direct half-etching method or the like method, on a striking-plane side of a metallic putter head in an integrated manner. The striking-plane side of the metallic golf putter is a side by which the metallic golf putter strikes a golf ball.

[Additional Matter]

The present invention is not limited to the description of the embodiments above, but may be altered by a skilled person within the scope of the claims. An embodiment based on a proper combination of technical means disclosed in different embodiments is encompassed in the technical scope of the present invention.

Industrial Applicability

Since the putter face of the present invention and the golf putter of the present invention including the putter face can efficiently create topspin on a golf ball, the putter face of the present invention is useful as a putter face and the golf putter including the putter face is useful as a golf putter.

REFERENCE SIGNS LIST

1 Putter Head
2 Putter Face
3 Repulsive Elastic Member
7 Golf Ball
21 Microscopic Protrusion
22 Protrusion Front Edge Surface
24 Protrusion Bottom Cut Plane
25 Linear Portion
26 Curve Portion
31, 41, 51, 61, 71 Microscopic Protrusion
125, 225, 325*a*, 325*b*, 425*a*, 425*b*, 525*a*, 525*b*, 525*c*, 525*d* Linear Portion
126, 226, 326, 426, 526 Curve Portion
h Microscopic-Protrusion Height
l Longer Diameter
w Shorter Diameter
pv First Pitch
ph Second Pitch
H Opening
G Ground Surface

The invention claimed is:

1. A putter face for use in a golf putter, comprising:

a plurality of microscopic protrusions which have stiffness higher than that of a golf ball and which are smaller than intervals between dimples of the golf ball, each of the plurality of microscopic protrusions having an end having a protrusion front edge surface formed in a planar shape, a periphery of the protrusion front edge surface including a plurality of linear portions facing each other and a plurality of curve portions facing each other, the plurality of linear portions extending in a horizontal direction of a face plane of the putter face which horizontal direction the face plane is supposed to have at a time of striking the golf ball, the periphery of the protrusion front edge surface forming a racetrack shape (i) which is defined by a pair of the linear portions facing each other and a pair of the curve portions facing each other and (ii) which has a longer diameter of not less than 0.3 mm but not more than 0.5 mm and a shorter diameter of not less than 0.1 mm but not more than 0.2 mm.

2. The putter face as set forth in claim 1, wherein:

each of the plurality of microscopic protrusions has a height of not less than 0.1 mm but not more than 0.2 mm, which height is defined by a distance from the protrusion front edge surface to a protrusion bottom cut plane, which is a cut plane of a bottom section of said each of the plurality of microscopic protrusions.

3. The putter face as set forth in claim 1, wherein:

the plurality of microscopic protrusions are provided such that they are equally distanced from each other at a given first pitch in a vertical direction of the face plane while they are equally distanced from each other at a given second pitch in the horizontal direction of the face plane, which given second pitch is longer than the given first pitch.

4. The putter face as set forth in claim 1, wherein:

the plurality of microscopic protrusions are adjacent to each other with a minimum distance of not less than 0.2 mm but not more than 0.5 mm in the vertical direction of the face plane, and with a minimum distance of not less than 0.2 mm but not more than 0.5 mm in the horizontal direction of the face plane.

5. The putter face as set forth in claim 1, wherein:

the plurality of microscopic protrusions are provided with such a density that a number of the microscopic protrusions formed per unit area of the face plane is not less than 100 pieces/$cm^2$ but not more than 670 pieces/$cm^2$.

6. The putter face as set forth in claim 1, wherein:

the plurality of microscopic protrusions are formed by a half-etching method.

7. The putter face as set forth in claim 1, being made from one selected from the group consisting of iron, copper, stainless steel, 42 Ni—Fe alloy, nickel-cobalt ferrous alloy, nickel, brass, permalloy, and metal amorphous.

8. A golf putter comprising:

a putter face as set forth in claim 1;

a repulsive elastic member provided so as to face a side of the putter face which side is opposite to the face plane of the putter face; and a putter head provided such that the putter head and the putter face sandwich the repulsive elastic member.

* * * * *